United States Patent [19]

Webster, III

[11] Patent Number: 4,970,508

[45] Date of Patent: Nov. 13, 1990

[54] SYSTEM FOR MONITORING SWITCH LOCATIONS

[76] Inventor: Daniel T. Webster, III, 223 Ravenscliff Rd., St. David's, Pa. 19087

[21] Appl. No.: 361,542

[22] Filed: Jun. 5, 1989

[51] Int. Cl.[5] ..... G08B 27/00

[52] U.S. Cl. ..... 340/825.79; 340/825.1; 340/825.36; 340/509; 340/518; 340/524

[58] Field of Search ..... 340/825.36, 325.37, 340/825.79, 825.96, 825.1, 825.16, 518, 521, 524, 525, 509, 664, 664, 506, 505; 341/26

[56] References Cited

U.S. PATENT DOCUMENTS

| | | | |
|---|---|---|---|
| 3,746,880 | 7/1973 | Iritani et al. | 340/644 |
| 3,786,501 | 1/1974 | Marnerakis | 340/509 |
| 3,940,739 | 2/1976 | Quimet | 340/518 |
| 4,227,180 | 10/1980 | Yasuda et al. | 340/825.1 |
| 4,250,501 | 2/1981 | Pokrandt | 340/644 |
| 4,529,970 | 7/1985 | Wynne | 340/509 |
| 4,529,971 | 7/1985 | James | 340/509 |
| 4,549,170 | 10/1985 | Serres et al. | 340/518 |
| 4,584,555 | 4/1986 | Domorazek | 340/644 |

OTHER PUBLICATIONS

"WHAM Security System—The Self-Storage Industry Standard" 6/88.

"WHAM SECURITY SYSTEM Sample Journal Tape" 6/88.

*Primary Examiner*—Donald J. Yusko
*Assistant Examiner*—Eric O. Pudpud
*Attorney, Agent, or Firm*—Dann, Doreman, Herrell and Skillman

[57] ABSTRACT

A system is provided for electronically monitoring a group of sensor switches employed at remote locations in security or alarm systems. To monitor the status of individual switches, a matrix of conductors is employed. The matrix has a predetermined number of send conductors by a predetermined number of return conductors. Switch circuits each having a diode connected in series with one of the sensor switches are connected at selected crosspoints of the matrix of conductors between respective send and return conductors. Line selection circuitry responsive to an input signal from a computer selectively permits the supply of a sourcing voltage potential to at least a selected one of the send and return conductors and the supply of a sinking voltage potential to at least a selected one of the remaining send and return conductors. Monitoring circuity senses current flow through the selected send and return conductors supplied with the sourcing and sinking voltage potentials to monitor the status or change in status of any selected switch or conductor.

26 Claims, 10 Drawing Sheets

SYSTEM FOR MONITORING SWITCH LOCATIONS

FIELD OF THE INVENTION

The present invention relates to a system for monitoring a plurality of switch locations and, more particularly, to a system for monitoring the status of a group of switches, such as alarm or detection switches, arranged at crosspoints of a matrix of conductors at remote locations.

BACKGROUND OF THE INVENTION

Conventionally, systems have been employed to electronically monitor a series of unattended remote locations. Common types of monitoring systems use a group of sensor switches, such as fire alarm or motion detection switches, positioned at the desired locations.

Often a series of unattended doors and windows must be electronically monitored by a security system employing a group of motion detection switches for sensing the opening and closing of the respective doors and windows. Another application generally requiring a large number of sensor switches is the field of fire prevention where a group of alarm switches must be monitored for proper operation.

Since the reliability of a fire or security system is often the primary concern of the user, monitoring the status of the remote sensor switches employed in such systems for both normal and abnormal operation becomes extremely important.

Of course, maintaining system reliability becomes even more difficult as the number of sensor switches employed in a system increases. Even a single undetected switch fault adversely impacts on the reliability. If a faulty sensor switch fails to detect the unauthorized opening of a door, user confidence is eroded and the system is of little value. Consequently, reliable monitoring requires systematic detection of both fault and tampering conditions for each and every sensor switch used in the system.

In order to provide effective monitoring, different types of fault conditions must also be detected and distinguished. Installation of a security system often requires the connection of sensor switches to unique pairs of a series of coded wires. Because installation faults such as reverse connections or cross wirings will occasionally occur, monitoring the switch locations for proper installation is certainly desirable.

Even when properly installed, however, a malfunction may still occur through inadvertent grounds or shorts to the system conductors. Prompt detection by the monitoring system not only of the existence of a short but also the location of the short enables efficient repair to the system and greatly reduces system down time.

Another problem which might arise is tampering to the security or alarm system. In order to be effective, the monitoring system must be able to detect acts of tampering which defeat the normal operation of any sensor switch. Since tampering often involves the shorting of a sensor switch or the grounding of conductors leading to the switch, such occurrences must be sensed and detected to maintain system reliability.

In accordance with the present invention, an effective system is provided for electronically monitoring the status of a group of switches at remote locations. The system permits accurate and reliable monitoring of installation faults, inadvertent grounds and shorts, as well as unauthorized alterations to the system caused by tampering.

SUMMARY OF THE INVENTION

In accordance with the present invention, a system for monitoring a plurality of switch locations is provided. More specifically, the system electronically monitors the status of a group of sensor switches positioned at remote locations in order to detect fault conditions.

At least one matrix of conductors is provided having a predetermined number of send conductors by a predetermined number of return conductors. The matrix of conductors includes crosspoints between the send and return conductors to permit interconnection of selected send conductors with selected return conductors.

Individual switch circuits are connected at selected crosspoints of the matrix so that each of the switch circuits connects a respective send conductor with a respective return conductor. Each of the switch circuits incorporates a diode connected in series with one of the sensor switches between the respective send and return conductors so as to permit current flow through each switch circuit only in the direction from the respective return conductor to the respective send conductor.

The system also includes line selection circuitry which is responsive to an input signal for selecting sets of send and return conductors of the matrix for monitoring. The line selection circuitry responds to the input signal to selectively permit the supply of a sourcing voltage potential to a selected set of any of the send and return conductors and the supply of a sinking voltage potential to a selected set of any of the remaining send and return conductors. In a specific application, the line selection circuitry may selectively permit the supply of the sourcing voltage potential to at least a selected one of the send and return conductors and the supply of the sinking voltage potential to at least a selected one of the remaining send and return conductors.

Monitoring circuitry is provided for sensing current flow through selected subsets of the sets of send and return conductors supplied with the sourcing and sinking voltage potentials to monitor the status of such conductors. In specific application, the monitoring circuitry senses current flow through at least a selected one of the send and return conductors supplied with the sourcing voltage potential as well as any current flow through at least a selected one of the remaining send and return conductors supplied with the sinking voltage potential. The monitoring circuitry thereby monitors the status of the selected conductors supplied with the sourcing and sinking voltage potentials.

In a specific embodiment, different pairs of send and return conductors are systematically selected for monitoring to enable the detection of any status changes in the sensor switches. The system has the capability to enable either a forward or reverse voltage potential to be supplied to the respective pairs of conductors. For added versatility, the system may also enable selected pairs of send lines or selected pairs of return lines to be biased for the purpose of detecting fault conditions on such conductors. In an expanded system, sets of selected send and return lines may be simultaneously monitored for status changes.

In applications in which relatively large numbers of switch locations must be monitored, additional sets of matrices of conductors can be added to the system.

Under these circumstances, additional switch circuits are connected at selected crosspoints of each additional matrix of conductors. Separate line selection circuitry is provided for each set of matrices to permit the supply of sourcing voltage potential to a selected set of the send and return conductors of the respective set of matrices and the supply of a sinking voltage potential to a selected set of the remaining send and return conductors of the respective set of matrices. In order to permit selected subsets of conductors in each set of matrices to be monitored, separate monitoring circuitry may be provided for each set of matrices.

When multiple sets of matrices are employed, the monitoring system includes a status output for each set of matrices to enable the system to monitor selected subsets of the sets of send and return conductors supplied with the sinking and sourcing voltage potentials in each set of matrices. Set selection circuitry responsive to an input signal is also provided to enable a selected set of matrices to output the status of the selected subset of the set of send and return conductors supplied with the sourcing voltage potential in such respective set and to output the status of the selected subset of the set of send and return conductors supplied with the sinking voltage potential in such respective set.

BRIEF DESCRIPTION OF THE DRAWINGS

The foregoing summary, as well as the following detailed description of the preferred embodiments of the present invention, will be better understood when read in conjunction with the accompanying drawings, in which.

DETAILED DESCRIPTION OF THE PREFERRED EMBODIMENTS

Figure 1:
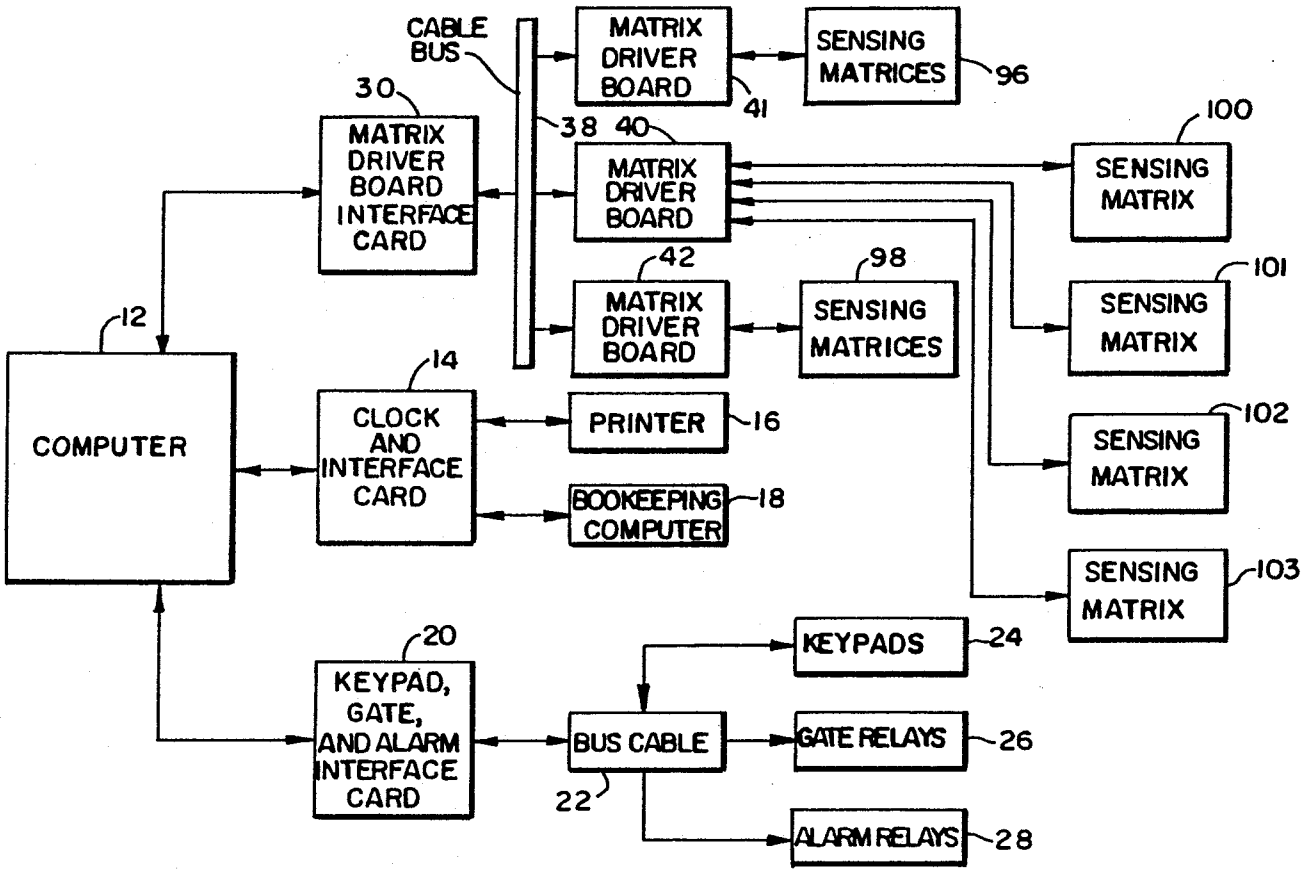
FIG. 1 is a block diagram of a security and alarm system incorporating a system for monitoring a plurality of switch locations in accordance with the present invention.

Referring to the drawings and, particularly to FIG. 1, a security and alarm system for monitoring a plurality of remote locations is depicted. In one specific application, the computer system is employed as a security and alarm system for self-service storage facilities having individual storage units for lease by tenants. The security and alarm system can also be adopted for use in a wide variety of diverse applications ranging, for example, from high rise apartment, hotel or office buildings to industrial applications employing groups of switches for manufacturing processes.

Typically, each self-storage unit, for example, has a lockable door to permit the tenant to have secured access to the tenant's individual self-service storage unit. As part of the security system, a separate sensor switch cooperates with the door to each unit to sense door openings and closings.

The security and alarm system incorporates an electronic monitoring system for monitoring the status of the sensor switches in addition to the conductors connecting such switches for fault and tamper conditions. As shown in FIG. 1, the security and alarm system employs a computer 12 which incorporates the operating program for the complete security or alarm system. The computer 12 also includes the operating program for the electronic monitoring system.

As part of the security and alarm system, the computer 12 includes an internal keypad, gate and alarm interface card 20 which is connected with an external bus cable 22. The bus cable 22 connects the computer 12 through the interface card 20 with external keypads 24, gate relays 26 and alarm relays 28.

A separate keypad 24 is mounted at the main gates for the facility or at the entrance gate to a group of units to electronically lock and unlock such gates. In order to gain access through such gates, the tenant must enter an assigned security code onto the keypad 24. Upon entry of the proper code, the computer 12 actuates the gate relay 26 to open the respective gate and simultaneously disarms the alarm of such tenant's individual storage unit. The computer 12 can be programmed so that tenants may be granted access through the main gates only during selected hours.

In order to enhance security, alarms and alarm type devices may be actuated by alarm relays 28 in response to selected events or criteria. For example, the alarm relays 28 may selectively control sirens, security lights, bells, or even actuate communication systems to contact the police in response to tampering to the system or to the unauthorized opening of a unit.

In order to maintain a permanent record of events, such as the opening and closing of storage unit doors, the system includes an external printer 16 which is connected with the computer 12 by a clock and port interface card 14 internal to the computer. A separate bookkeeping computer 18 is also connected with the main computer 12 through the clock and port interface card 14. The bookkeeping computer 18 can be used to supply the main computer 12 with information indicating, for example, that a particular tenant's account is delinquent and thereby prevent the tenant from gaining access to the facility.

Figure 10:
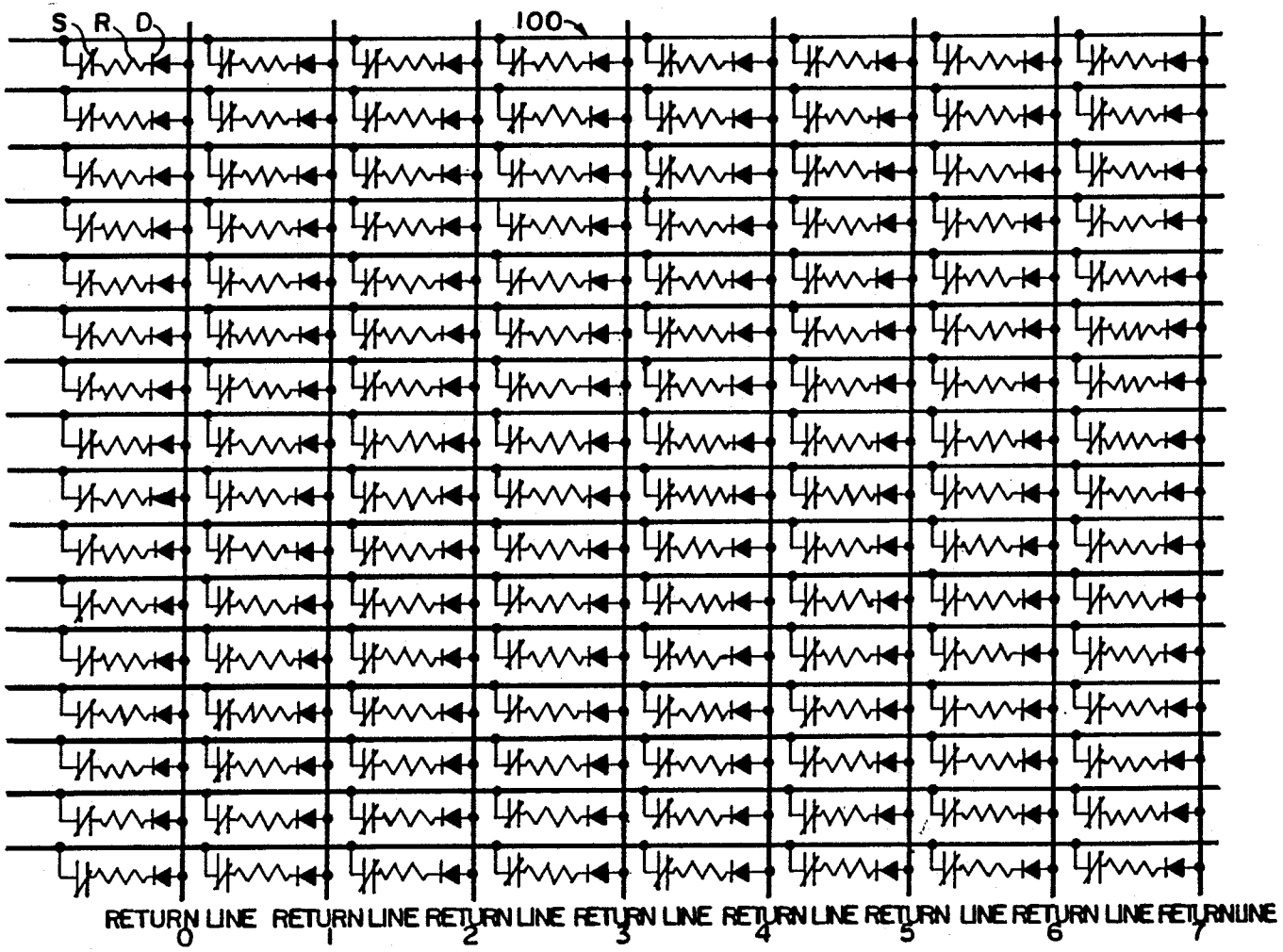
FIG. 10 is a schematic representation of a typical sensing matrix configuration employed in the system of the present invention.

For the purpose of monitoring at the remote storage units, a normally-closed sensing switch S, as shown in FIG. 10, is installed at each storage unit to detect when the door to the respective unit is opened and closed. Each sensing switch S opens when the door to the respective storage unit is opened and closes when the door to the unit is closed.

In order to permit systematic electronic monitoring, the sensing switches S are connected at crosspoints of a matrix of send and return conductors. Matrices having different numbers of send and return conductors may be used to suit different applications. As shown in FIG. 10, a typical sensing matrix 100 is depicted having a predetermined number of send conductors, such as send line 0 through send line F, by a predetermined number of return conductors, such as return line 0 through return line 7. Switch circuits having a sensor switch S, a resistor R, and a diode D connected in series, as shown in FIG. 10, are connected at the crosspoints of the send and return conductors of the matrix.

As shown in FIG. 1, the sensing matrix 100 is connected with the computer 12 through a matrix driver board 40 connected to a cable bus 38. The cable bus 38 is in turn connected with a matrix drver board interface card 30 which is internal to the computer 12.

When additional sensing switches S are required for monitoring greater numbers of switch locations, additional matrices of conductors 101, 102 and 103 can be used as depicted in FIG. 1. To add the additional matrices 101, 102 and 103 to the system, the matrices can be connected to the matrix driver board 40 as shown in FIG. 1. As such, a single matrix driver board 40 can accommodate a set of matrices.

In applications in which even more switch locations must be sensed than are available through a single set of sensing matrices 100, 101, 102 and 103, additional sets of sensing matrices 96 and 98 may be added to the system. Each additional set of sensing matrices is connected with the cable bus 38 by a respective matrix driver board. As shown in FIG. 1, matrix board 41 connects one set of sensing matrices 96 with the cable bus 38 while matrix driver board 42 connects another set of sensing matrices 98 with the cable bus 38. In applications requiring still larger numbers of sensing switches S, additional sets of switching matrices can be added to the system by connecting each additional set of sensing matrices with a respective matrix driver board connected to the cable bus 38.

Figure 2:
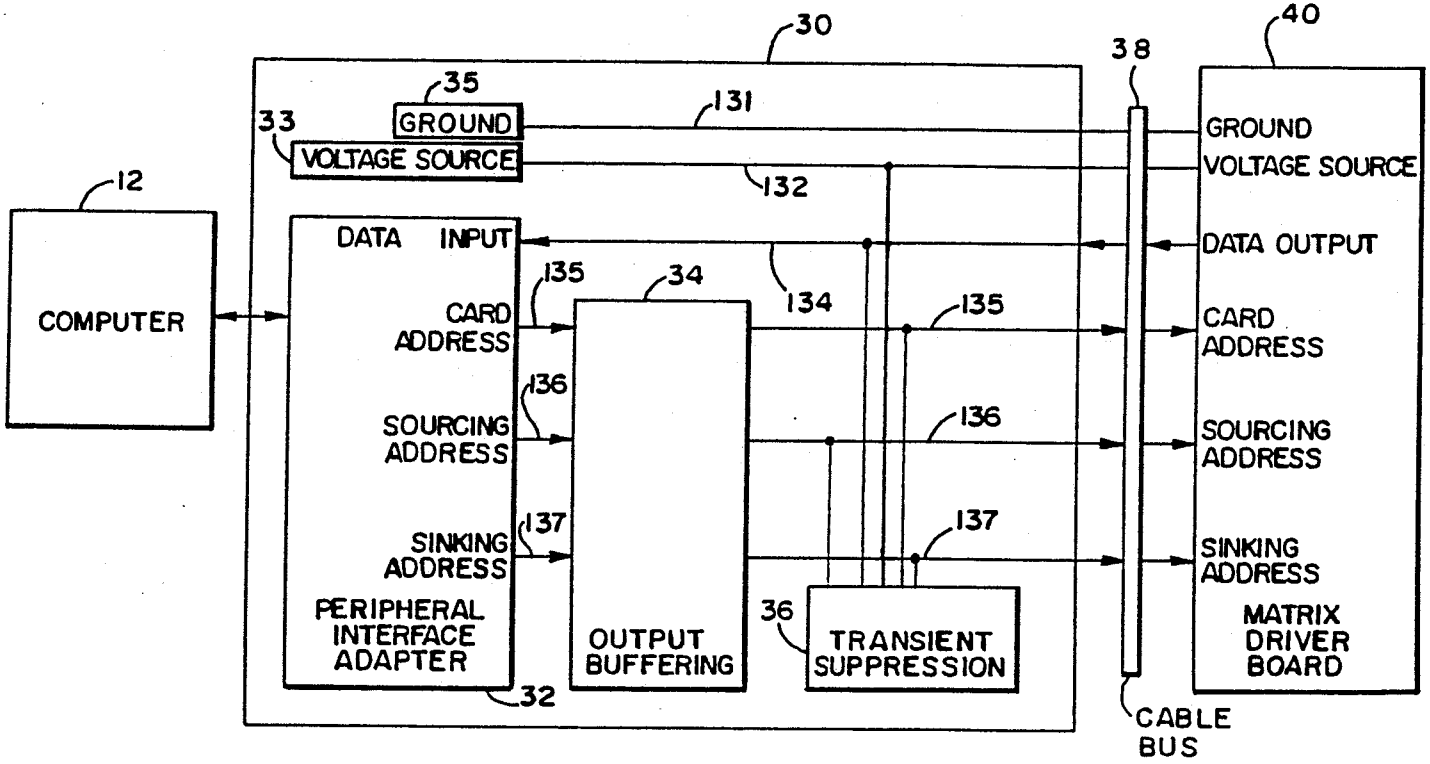
FIG. 2 is a block diagram of a matrix driver board interface card for a matrix driver board used in the system of the present invention.

The circuitry for interconnecting the sensing matrices with the computer 12 will now be analyzed. The matrix driver board interface card 30 is connected internally of computer 12 to interface the computer 12 with the matrix driver boards 40, 41 and 42. As shown in FIG. 2, the matrix driver board interface card 30 includes a source of voltage 33 and a ground 35 which may be supplied by the computer 12 or from independent sources. Two ground lines 131 and two voltage source lines 132 are connected with the corresponding ground 35 and voltage source 33. The matrix driver board interface card 30 includes a periferal interface adapter (PIA) 32 which is connected with the computer 12. The PIA 32 includes two data input pins connected with two data input lines 134.

The PIA 32 also includes sixteen pins for connection with address lines 135, 136 and 137. More specifically, four of the sixteen pins are used as card address for addressing the matrix driver boards 40, 41 and 42. For this purpose, the card address pins of the PIA 32 are respectively connected with four card address lines 135. The PIA 32 also includes six pins available as a sourcing address to select the individual send and return lines of the sensing matrices to be supplied with a sourcing voltage potential from the voltage source. For this purpose, the six pins providing the sourcing address are respectively connected with six sourcing address lines 136. The PIA 32 also includes six pins which provide a sinking address to select the individual return and send lines to be connected with a sinking voltage potential, such as ground. As such, the six pins providing the sinking address are respectively connected with six sinking address lines 137.

Output buffering circuitry 34 is provided to receive the card address lines 135, the sourcing address lines 136 and the sinking address lines 137 from the PIA 32. The output buffering circuitry 34 receives the address information supplied by the computer 12 on the address lines 135, 136 and 137 from the PIA 32. The address information from the output buffering circuit 34 is then supplied to the various matrix driver boards 40, 41 and 42 by cable bus 38.

In order to prevent damage to the operative circuitry on the matrix driver board interface card 30, transient suppression circuitry 36 is provided. The transient suppression circuitry is connected with the voltage source lines 132, the data input lines 134 and the address lines 135, 136 and 137 in order to ground transient voltages occurring on any of the lines. For this purpose, the transient suppression circuitry may include high power Zener-type diodes connected between each of the lines and ground. The transient suppression diodes function to distribute unusual transient loads, such as lightning strikes, over a large number of the conductors to maintain such conductors generally at or near the same voltage potentials to prevent damage to the associated circuitry.

From the matrix driver board interface card 30, the address lines 135, 136 and 137 are supplied to the cable bus 38 so that the addressing information from such lines may be supplied to the matrix driver boards, such as matrix driver board 40 as shown in FIG. 2. The data input lines 134 of the matrix driver board interface card 30 are also connected with cable bus 38 so that such lines may be respectively connected to each matrix driver board, such as matrix driver board 40 as shown in FIG. 2. Likewise, the ground lines 131 from ground 35 and the voltage source lines 132 from voltage source 33 on the matrix driver board interface card 30 are connected with the cable bus 38 for subsequent connection with the matrix driver boards.

Figure 3:
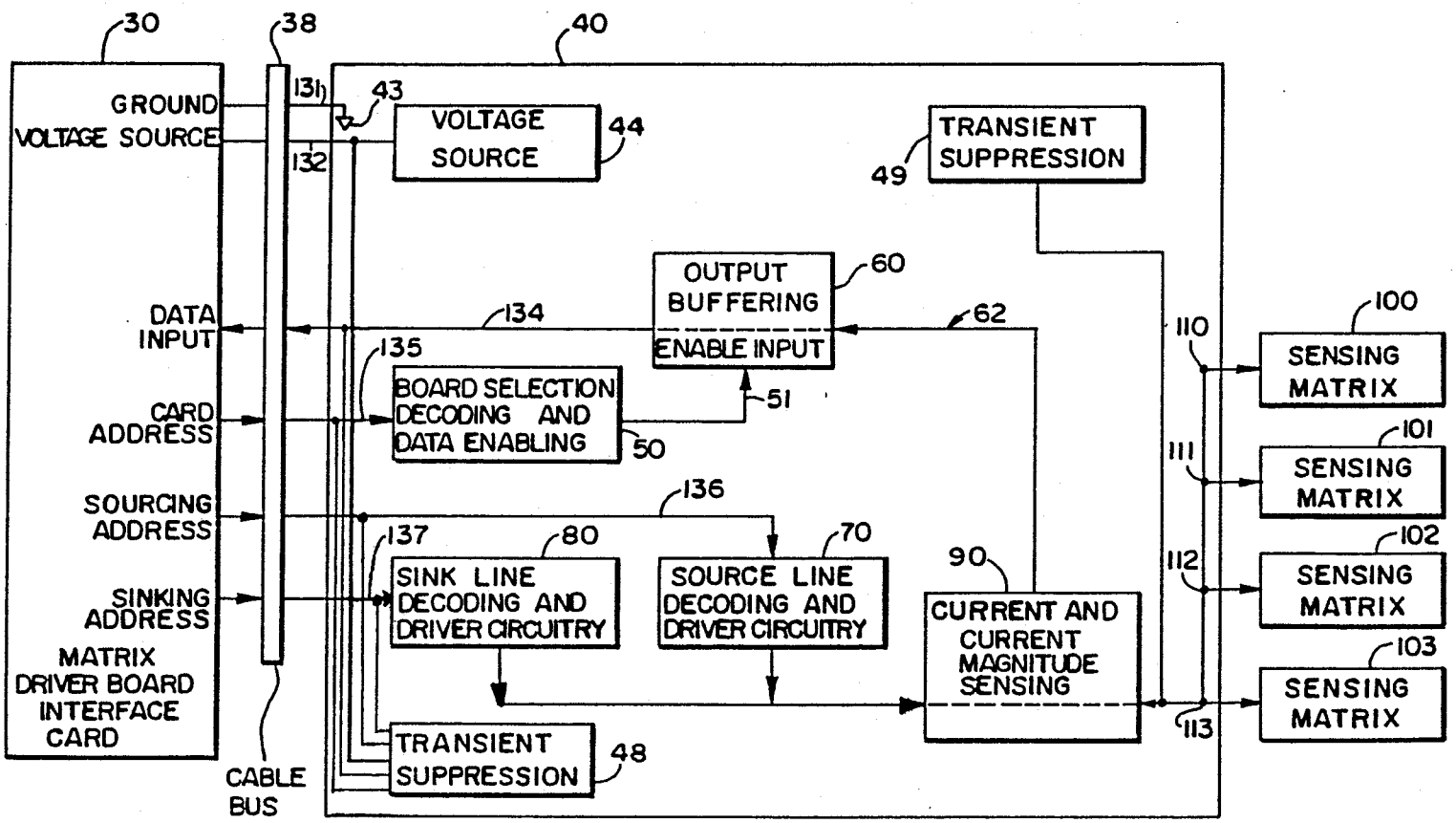
FIG. 3 is a block diagram of the matrix driver board connected with a set of sensing matrices.

Referring to FIG. 3, the operational circuitry of matrix driver board 40 is depicted in block diagram. The matrix driver board 40 includes an electrical ground 43 which is connected with ground lines 131 to provide a source of sinking voltage potential on the matrix driver board 40. Similarly, a voltage source 44 on the matrix driver board 40 is connected with voltage source lines 132 to provide a source of sourcing voltage potential.

Before examining the specific operation of the circuitry on the matrix driver board 40, the operation of a typical sensing matrix of conductors, such as matrix 100 shown in FIG. 10, will be considered first. A matrix of sensing conductors, such as matrix 100, includes a predetermined number of send conductors by a predetermined number of return conductors. Typically, the send and return conductors run coextensively as individual conductors of a multi-conductor cable. Different colors are often assigned to individual conductor lines so that individual lines can be readily identified and distinguished.

As shown in FIG. 10, a matrix of conductors 100 is depicted having sixteen send lines, send line 0 through send line F, and eight return lines, return line 0 through return line 7. The matrix 100 of conductors as shown in FIG. 10 includes schematically represented crosspoints between the respective send and return conductors to permit interconnection of selected send conductors with selected return conductors. In application, the crosspoints between respective send and return conductors at which a desired switch oircuit is connected may occur at any location along the length of the cable.

In applications in which the sensing switch S is employed to sense the opening and closing of a door to a storage unit, the switch is typically a normally closed switch. Alternatively, where a sensing switch S is employed in a fire alarm system, for example, the switch S may be a normally open switch.

When normally closed sensing switches S are employed, as depicted in FIG. 10, the switch circuits containing the sensing switches S are connected at the selected crosspoints of the return and send conductors of the matrix so that under normal operation each switch circuit will permit current flow only from the respective return line to the respective send line. The diode D in each switch circuit prevents current flow from the respective send line to the respective return line.

By supplying a sourcing voltage potential to a selected return line, such as return line 2, and supplying a sinking voltage potential to a selected send line, such as send line C, the status of the sensing switch connected between the two lines can be monitored by sensing the current flow through the respective return line and the respective send line. Enhanced monitoring capabilities are obtained by then reversing the potentials so that a sourcing voltage potential is supplied to the selected send line while a sinking voltage potential is supplied to the selected return line. The reversing of potentials during monitoring enables more precise identification of abnormalities such as conductor shorts, tampering shorts, and reverse polarity diodes.

The use of a matrix of send and return lines greatly facilitates monitoring. Any switch circuit n the matrix can be monitored simply by selecting its respective send and return lines for supply with sourcing and sinking voltage potentials and then sensing current flow through the respective lines. In fact, to permit systematic monitoring of every switch circuit, the computer 12 can be programmed to sequence through the respective send and return lines so that both forward and reverse biasing potentials are supplied to each individual switch circuit while the resulting current flow through the respective conductors is monitored.

In order to permit a selected set of the send and return lines to be supplied with a sourcing voltage potential and a selected set of the send and return lines to be supplied with the sinking voltage potential, line selection circuitry is provided. In general operation, the line selection circuitry may be responsive to an input signal supplied by the computer 12 to selectively permit the supply of the sourcing voltage potential to a selected set of none, one, or more of any of the send and return conductors and the supply of the sinking voltage potential to a selected set of none, one or more of any of the remaining send and return conductors. In specific operation of the embodiment depicted in FIGS. 1–10, the line selection circuitry is provided on the respective matrix driver boards 40, 41 and 42. The line selection circuitry responds to an input signal from the computer 12 to selectively permit the supply of the sourcing voltage potential to at least a selected one of any of the send and return conductors and the supply of the sinking voltage potential to at least a selected one of any of the remaining send and return conductors.

The input signal to the line selection circuitry of the matrix driver board 40 is provided by the computer 12 as an encoded input signal on the sourcing address lines 136 and the sinking address lines 137. The line selection circuitry includes decoder circuitry for decoding the encoded input signal supplied by the sourcing and sinking address lines 136 and 137 to select the respective send and return lines to be supplied with the sinking and sourcing voltage potentials.

The sourcing address lines 136 provide an encoded line sourcing signal in the form of a six bit address to line sourcing decoder and driver circuitry 70 shown in FIG. 3. The line sourcing decoder circuitry 70 decodes the encoded line sourcing signal provided on address lines 136 to select at least one of the send or return conductors to be supplied with the sourcing voltage potential.

Figure 5:
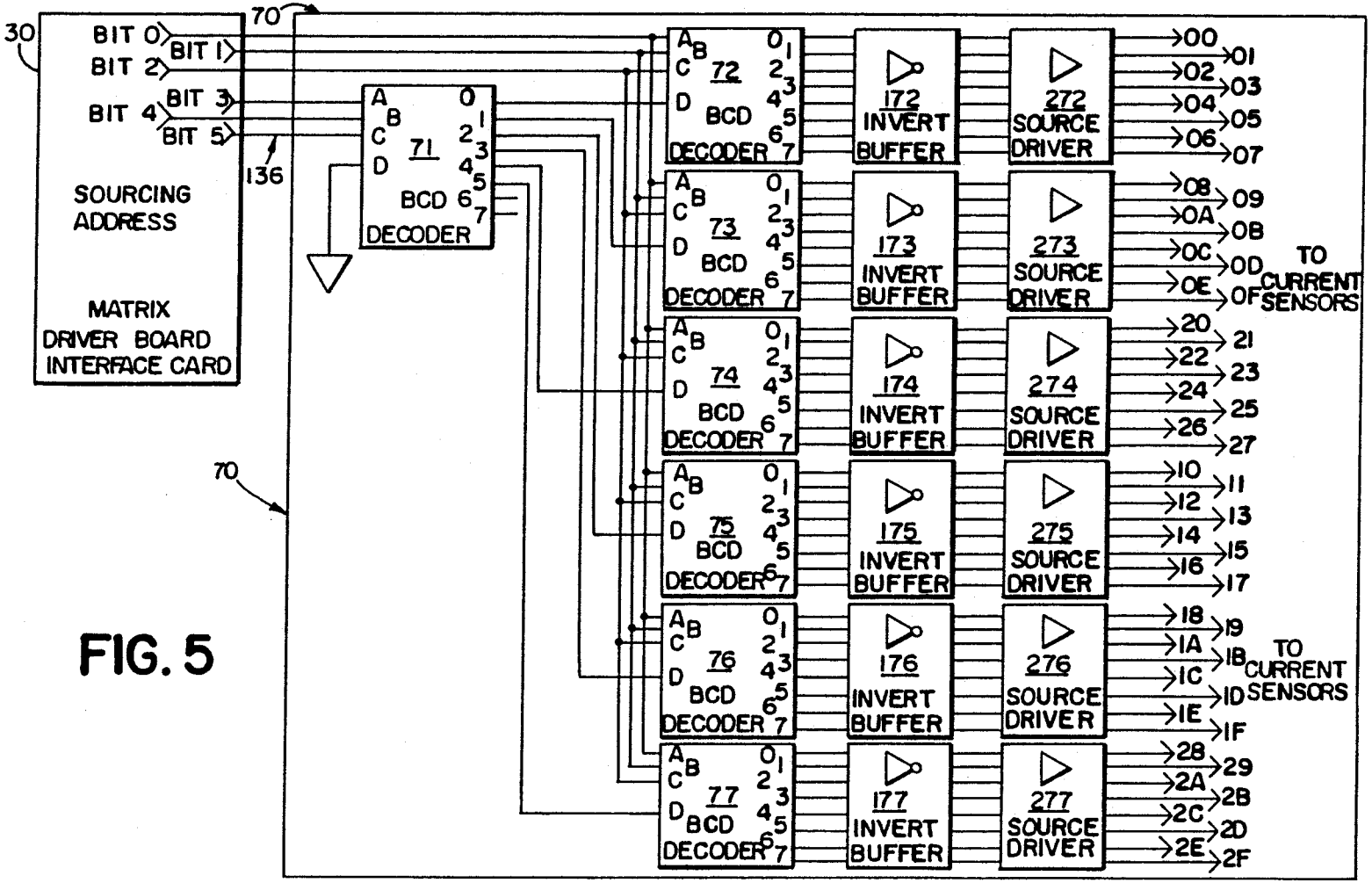
FIG. 5 is a schematic representation of source line decoding and driver circuitry employed on the matrix driver board.

The line decoder circuitry 70 for decoding the six-bit line sourcing signal is depicted in greater detail in FIG. 5. The six sourcing address lines 136 from the matrix driver board interface card 30 are supplied to the line sourcing decoder and driver circuitry 70 through the cable bus 38 (not depicted in FIG. 5). The line sourcing decoder circuitry 70 includes tiered decoders having a primary decoder in the form of a BCD decoder 71 and a series of secondary decoders in the form of BCD decoders 72, 73, 74, 75, 76, and 77. A segment of the encoded line sourcing signal represented by bits 3, 4 and 5 of the sourcing address lines 136 are supplied as an input to the primary decoder 71 at input pins A, B and C.

As shown in FIG. 5, output pin 0 from the primary decoder 71 is connected as the D input to secondary decoder 72. Likewise, output pins 1 through 5 of the primary decoder 71 are connected in a selected sequence to the D inputs of the secondary decoders 73 through 77. Output pins 6 and 7 of the primary decoder 71 are left unconnected to provide test lines. Alternatively, pins 6 and 7 may be connected for use with additional sensing matrices.

The primary decoder 71 decodes the binary coded input provided by bits 3 through 5 of the sourcing address into a decimal output so that a selected one of the output pins 0–7 of the primary decoder 71 is driven low. When one of the pins 0–5 is driven low, the particular secondary decoder to which such pin is connected is thereby enabled for output. When pins 6 or 7 are driven low, no secondary decoder is enabled. As such, bits 3–5 of the sourcing address are decoded by the primary decoder 71 to select which, if any, of the secondary decoders 72–77 will be enabled for output.

Another segment of the encoded line sourcing signal as provided by bits 0, 1 and 2 of the sourcing address lines 136 is supplied as an input to each of the secondary decoders 72 through 77. For this purpose, bits 0–2 of the sourcing address lines 136 are respectively supplied to input pins A, B and C of each secondary decoder 72–77. As such, bits 0–2 of the sourcing address lines select the particular one of the decimal output pins 0–7 of the secondary decoders which will generate an output while the primary decoder 71 in response to the input of bits 3–5 of the sourcing address selects the particular secondary decoder which will generate the output.

The output pins 0–7 of the secondary decoders 72–77 are respectively connected to respective output lines 00 through 2F, as depicted n FIG. 5. In overall operation, the six-bit sourcing address lines 136 select the particular one of the output lines 00–2F to be supplied with a sourcing voltage potential. The particular output line selected by the sourcing address for supply with a sourcing voltage potential is determined by a low output generated at the respective output pin of the respective secondary binary decoder corresponding to such line. For example, if output line 15 is selected for supply with a sourcing voltage potential, the six bits 0–5 of the sourcing address lines 136 will be decoded so that secondary decoder 75 produces a low output at output pin 5.

The output pins of the secondary decoders 72–77 are supplied to inverter buffers 172, 173, 174, 175, 176 and 177 respectively. In turn, the outputs of the inverter buffers 172–177 are supplied as inputs to source drivers 272, 273, 274, 275, 276 and 277 respectively. The source drivers are supplied with a voltage potential from voltage source 44 on the matrix driver board 40. Consequently, when secondary decoder 75 produces a low output on pin 5 to source output line 15, for example, the inverter buffer 175 inverts the low output from pin 5 of secondary decoder 75 so that a high output is supplied by the inverter buffer 175 to the respective source driver 275. The source driver 275 then produces a high output on output line 15 so that line 15 is supplied with a sourcing voltage potential.

It is also possible for the system to prevent the sourcing of any of the output lines 00 through 2F. For example, if the address received by the primary decoder 71 selects pins 6 or 7 of the primary decoder for output, then none of the output lines 00–2F will be selected for sourcing.

Output lines 00–2F are connected with corresponding send and return lines of sensing matrices 100, 101, 102 and 103. Supplying one of the output lines 00–2F with a sourcing voltage potential thereby supplies at least one of the send and return lines of one of the matrices 100–103 with a sourcing voltage potential.

Similar circuitry is provided on the matrix driver board 40 for selecting at least one particular send and return line for supply with a sinking voltage potential. In this regard, the matrix driver board 40 includes line sinking decoder and driver circuitry 80, as shown in FIG. 3. The line sinking decoder circuitry 80 receives an encoded line sinking signal in the form of a six-bit address from sinking address lines 137. The line sinking decoder circuitry 80 decodes the encoded line sinking signal provided as the six-bit address on the sinking address lines 137 to select at least one of the send or return conductors to be supplied with the sinking voltage potential.

Figure 6:
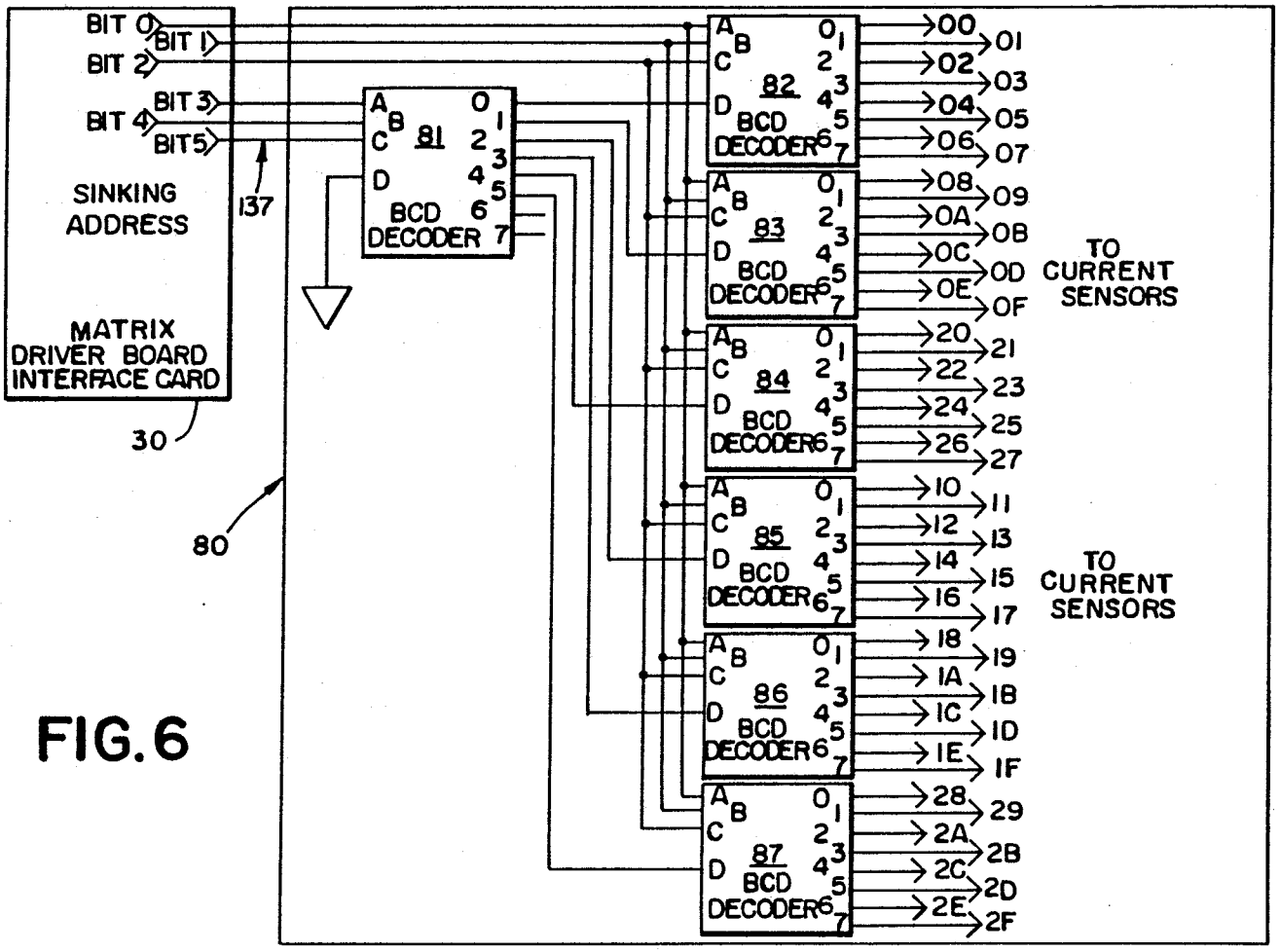
FIG. 6 is a schematic representation of sink line decoding and driver circuitry employed on the matrix driver board.

The line sinking decoder and driver circuitry 80 is depicted in greater detail in FIG. 6. As illustrated, the line sinking decoder circuitry 80 includes tiered decoder circuitry having a primary decoder 81 in the form of a BCD decoder and a series of secondary decoders in the form BCD decoders 82, 83, 84, 85, 86, and 87. A segment of the encoded line sinking signal as provided by bits 3, 4 and 5 of the sinking address lines 137 is supplied as an input to the primary decoder 81. Output pins 0 through 5 of BCD decoder 81 are connected in a selected sequence as inputs to the secondary decoders 82–87. The primary decoder 81 decodes the binary coded input supplied by bits 3–5 of the sinking address lines to select the particular secondary decoder 82–87 to enable for output.

Another segment of the encoded line sinking signal is provided by bits 0, 1 and 2 of the sinking address lines 137. Bits 0, 1 and 2 are supplied as inputs to each of the secondary decoders 82–87. The secondary decoders decode bits 0–2 of the sinking address to select the particular output pin, 0 through 7, of the secondary decoders for output. In overall operation, the primary decoder 81 enables a selected one of the secondary decoders 82–87 to generate an output in response to the encoded input signal received by the primary decoder 81 at bits 3–5 of the sinking address lines 137 while the enabled secondary decoder decodes bits 0–2 of the sinking address lines 137 to select which of its output pins 0–7 will produce a low output. The output pins 0–7 of the secondary decoders 82–87 are respectively connected with output lines 00–2F as shown in FIG. 6. Output lines 00–2F from the secondary decoders 82–87 are in turn connected with the corresponding output lines 00–2F from the source drivers 272–277 for secondary decoders 72–77.

When one of the output lines 00–2F is selected to provide a sinking potential to at least one of the corresponding return or send lines of a matrix, the respective secondary decoder 82–87 drives its corresponding output pin 0–7 low so that the corresponding output line 00–2F is also driven low to provide a sinking voltage potential on such line. For example, if output line 25 is selected for supply with a sinking voltage potential, the input received by the primary decoder 81 through bits 3–5 enables secondary decoder 84 to generate an output. The input received by the secondary decoder 84 through bits 0–2 of the sinking address lines causes the secondary decoder 84 to produce a low output at pin 5 to provide output line 25 with a sinking voltage potential.

Output pins 6 and 7 of the primary decoder 81 are not connected with any of the secondary decoders 82–87 in order to provide test lines or additional capability for extra matrices. Since pins 6 and 7 of the primary decoder 81 are left unconnected, it is possible that none of the output lines 00–2F will be selected for supply with a sinking voltage potential. As such, a tri-state system is provided in which each output line can be supplied with a sourcing voltage potential, a sinking voltage potential, or left floating in a high impedance state.

As shown in FIG. 3, common output lines 00–2F from the line sourcing decoder and driver circuitry 70 and the line sinking decoder and driver circuitry 80 are supplied as separate inputs to monitoring circuitry 90. In general operation, the monitoring circuitry 90 functions to sense current flow through selected subsets of the set of send and return conductors supplied with the sourcing voltage potential and the current flow through selected subsets of the set of send and return conductors supplied with the sinking voltage potential to monitor the status of the conductors. In specific operation of the embodiment depicted in FIGS. 1–10, the monitoring circuitry functions to sense the current flow through at least a selected one of the send and return conductors supplied with the sourcing voltage potential and the current flow through at least a selected one of the send and return conductors supplied with the sinking voltage potential.

Figures 7, 8:
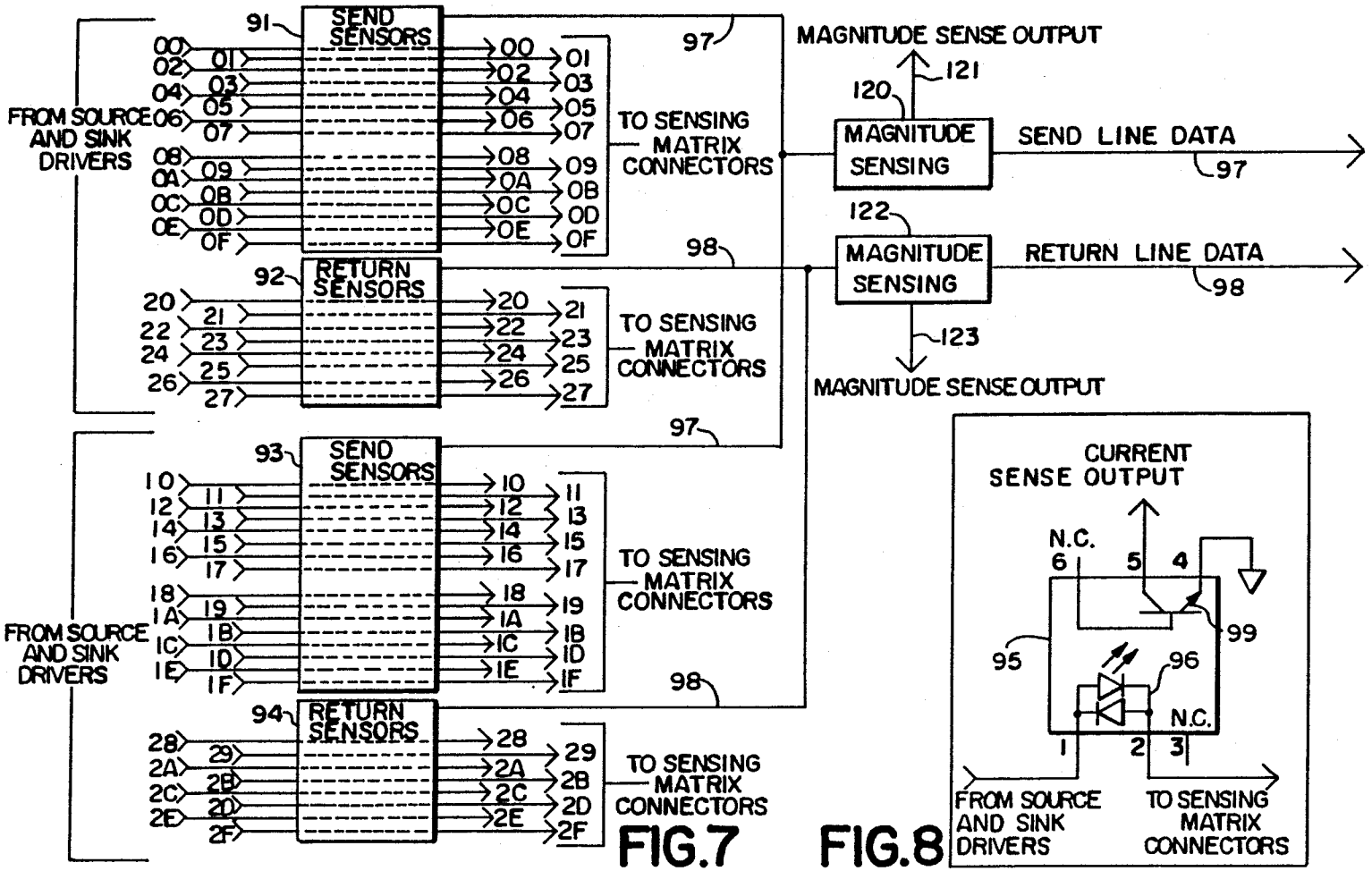
FIG. 7 is a schematic representation of current and current magnitude sensing circuitry employed on the matrix driver board.
FIG. 8 is a schematic representation of a current sensor employed on the matrix driver board.

As shown in FIG. 7, the monitoring circuitry 90 includes current sensing circuitry 91, 92, 93 and 94 for sensing current flow through output lines 00–2F. For sensing the magnitude of current flow, the monitoring circuitry 90 includes current magnitude sensing circuitry 120 and 122. As depicted in FIG. 7, output lines 00–OF pass through send line current sensors 91 and output lines 10–1F pass through send line current sensors 93. Likewise, output lines 20–27 pass through return line current sensors 92 while output lines 28–2F pass through return line current sensors 94.

Figure 9:
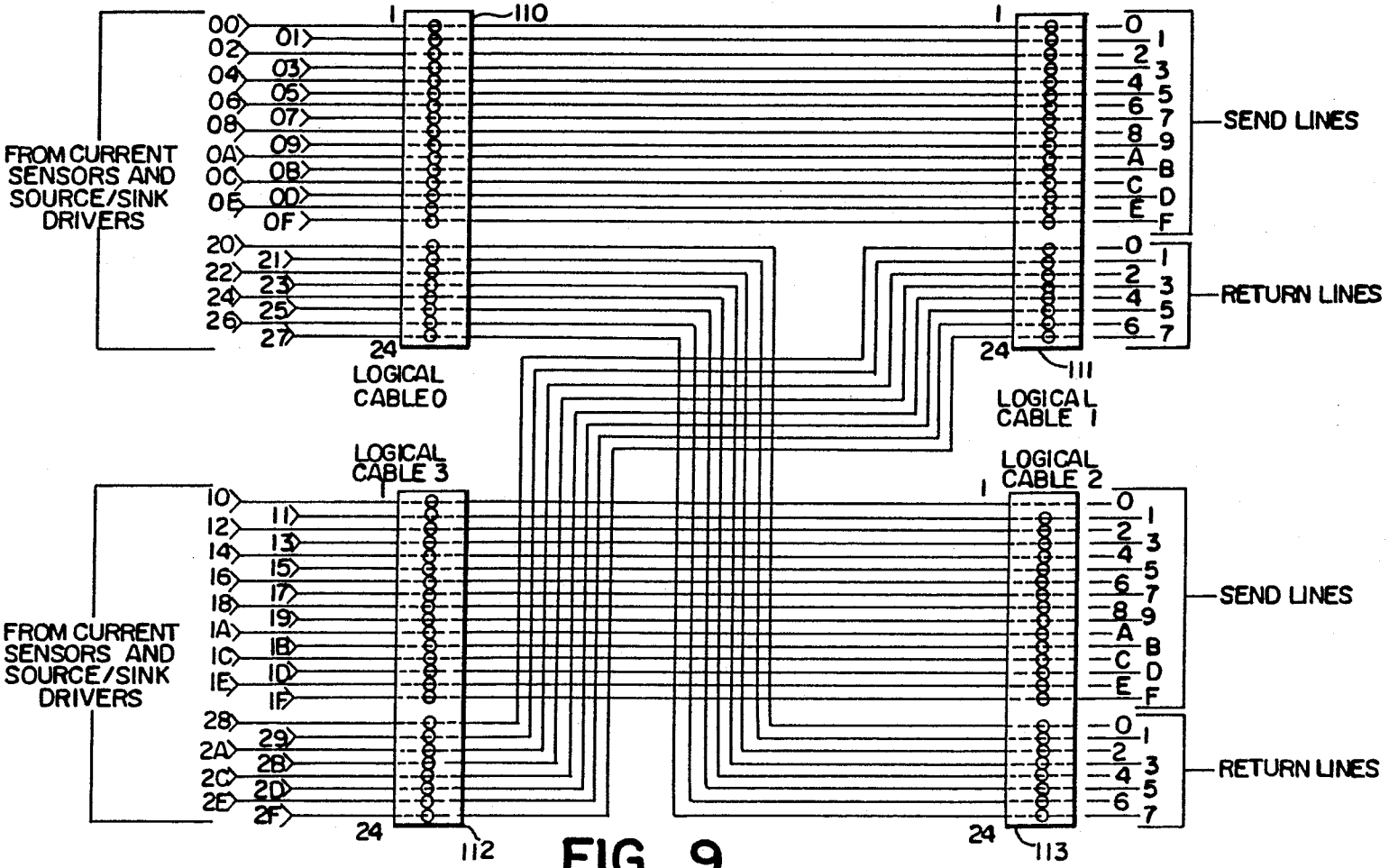
FIG. 9 is a schematic diagram of output connectors on the matrix driver board for connecting the matrix driver board with a set of sensing matrices.

After output lines 00–2F pass through the corresponding current sensing circuitry 91, 92, 93 and 94, such lines are connected with the output connectors 110, 111, 112, and 113 provided on the matrix driver board 40, as shown in FIGS. 3 and 9. Selected sets of the output lines 00–2F are connected to the individual output connectors 110, 111, 112 and 113. The output connectors are, in turn, respectively, connected with sensing matrices 100, 101, 102, and 103 as generally shown in FIG. 3.

As shown in FIG. 9, output lines 00–0F are connected with output connectors 110 and 111 for respective connection with send line 0 through send line F of the sensing matrices 100 and 101. Output lines 20–27 are connected with output connectors 110 and 113 for respective connection with return line 0 through return line 7 of sensing matrices 100 and 103. Output lines 10–1F are connected with output connectors 112 and 113 for respective connection with send line 0 through send line F of sensing matrices 102 and 103. Finally, output lines 28–2F are connected with output connectors 111 and 112 for respective connection with return line 0 through return line 7 of sensing matrices 101 and 102. As such, each one of the output lines 00–2F is connected with either two different send lines, with each of the two send lines being in a different matrix, or two different return lines, with each of the two return lines being in a different matrix.

Even through each one of the output lines 00–2F supplies either two different send lines or two different return lines, the layout of the connections between the output lines 00–2F and the send and return lines of matrices 100–103 ensures that any selected pairing of a send line with a return line from any matrix can be independently monitored.

In the present embodiment, each output connector 110–113 is adapted to supply a sensing matrix having sixteen send lines, send line 0 through send line F, and eight return lines, return line 0 through return line 7, as shown in FIG. 10. Output lines 00–2F are divided into sets of four matrices to utilize standardized 24 conductor cables for wiring the remote switch locations. Alternatively, a single matrix having 32 send conductors, send lines 00–0F and 10–1F, by sixteen return conductors, return lines 20–27 and 28–2F, could be utilized.

As shown in FIG. 3, transient suppression circuitry 49 in the form of transient suppression diodes is connected with each of the lines 00–2F to suppress transient voltages on such lines. Likewise, transient suppression circuitry 48 is connected with each of the voltage source lines 132, each of the data lines 134, and each of the address lines 135, 136, and 137 on the matrix driver board 40 to suppress transient voltages on any of those lines.

Referring to FIG. 7, the operation of the current sensing circuitry will now be considered in greater detail. As schematically depicted, send sensors 91 and 93 have outputs which are interconnected to provide a single status output line 97 for send line data. Similarly, the outputs from return sensors 92 and 94 are interconnected to provide a single status output line 98 for return line data.

In a specific design, each one of the send sensors 91 and 93 and each one of the return sensors 92 and 94 include a separate current sensor circuit 95, as depicted in FIG. 8, for each separate output line 00–2F. As such, each one of the return and send conductors of a respective matrix are connected with a respective one of the current sensor circuits 95. In operation, the current sensor circuits 95 function to sense current flow through the return and send conductors of a respective matrix or set of matrices.

As shown in FIG. 8, the current sensor circuit 95 is in the form of an output isolation device having an input pin 1 and an output pin 2 for connection with a respective one of the output lines 00–2F. Pin 5 of the output isolation device is connected with one of the output status lines 97 or 98 depending on whether the output isolation device 95 is used in a send sensor 91 and 93 or a return sensor 92 and 94. The output isolation device 95 senses current flow through the respective one of the output lines 00–2F to which such device is connected and generates an isolated output signal at the electrically isolated output pin 5 of the device in response to the detection of any current flow through the respective output line 00–2F to which the device 95 is connected.

An example will best illustrate the operation of the send and return sensors. With reference to FIG. 7, output line OB might be selected for supply with sourcing voltage potential while output line 26 is selected for supply with sinking voltage potential. In this event, send sensor 91 will sense any current flow through line OB by virtue of the respective current sensor circuit 95 connected with output line OB within send sensor 91. In response, the send sensor 91 will then generate a responsive output via the respective current sensor circuit 95 on output status line 97. Likewise, return sensor 92 will detect any current flow through output line 26 by virtue of the respective current sensor circuit 95 connected with output line 26 within return sensor 92. In response, the return sensor 92 will then generate a responsive output via the respective current sensor circuit 95 on output status line 98.

As shown in FIG. 8, the current sensor circuit 95 is in the form of an optoelectric output isolation device having LED circuitry 96 connected along a respective one of the output lines 00–2F. The LED circuit 96 functions to emit light when current flows through the respective output line 00–2F to which the respective LED circuitry 96 is connected. The optoelectric device also includes a phototransistor 99 having a grounded emitter at pin 4 and a collector which serves as the isolated output for the device at pin 5. The phototransistor 99 is responsive to the light emitted from the LED circuitry 96 to generate an isolated output signal at pin 5 when current flows through the respective one of the output lines 00–2F to which the device 95 is connected.

The isolated output provided at pin 5 of each of the devices 95 in the send sensors 91 and 93 are connected together to provide output status line 97. Likewise, the isolated outputs of the devices 95 in return sensors 92 and 94 are connected together to provide output status line 98. The status output lines 97 and 98 are connected to magnitude sensing circuitry 120 and 122 respectively.

When the current sensor devices 95 are designed to operate in a linear range, the magnitude of the output at pin 5 of each device 95 is dependent upon the magnitude of the current flowing through the respective one of the output lines 00–2F to which the device 95 is connected at pins 1 and 2. As such, the magnitude sensing circuitry 120 and 122 serves to detect the magnitude of the current respectively flowing through the status output lines 97 and 98. The magnitude of current flow detected by the respective magnitude sensor circuits 120 and 122 are respectively indicated at the magnitude sense outputs 121 and 123. As such, magnitude sensor circuitry 120 indicates the magnitude of current flow through the selected send conductors of a matrix while magnitude sensor circuitry 122 indicates the magnitude of the current flow through the selected return conductors.

As previously mentioned, the system can be expanded to accommodate additional sets of matrices. As shown in FIG. 1, an additional set of matrices 96 can be added by connecting the set of matrices with a separate matrix driver board 41 connected to cable bus 38. To further increase the number of sensing circuits, an additional set of matrices 98 can be added to the system by connection to a separate matrx driver board 42 connected with the cable bus 38. Still, additional sets of matrices can be added in a similar manner to provide the required number of sensing switch circuits.

When additional sets of matrices are added to the system, set selection circuitry is provided on each matrix driver board 40, 41 and 42 to enable a selected set of the matrices to output the status of a selected subset of the set of send and return conductors supplied with the sourcing voltage potential in such respective set of matrices and to output the status of a selected subset of the set of send and return conductors supplied with the sinking voltage potential in such set of matrices. In more specific application, the set selection circuitry enables a selected set of matrices to output the status of at least a selected one of the send and return conductors supplied with sourcing voltage potential in such set of matrices and to output the status of at least a selected one of the send and return conductors which is supplied with the sinking voltage potential in such respective set of matrices. To separately monitor the different sets of matrices, the set selection circuitry of each set of matrices is responsive to an input signal supplied by computer 12 to selectively enable a selected set of matrices to output its respective send line data and return line data. The card address lines 135 provide the necessary input signal to the respective matrix driver boards 40, 41 and 42 for enabling an output from a particular set of matrices.

As shown in FIG. 3, the card address lines 135 provide an encoded set selection signal in the form of a four-bit address to set decoder circuitry 50 on the matrix driver board 40. The set decoder circuitry 50 functions to provide board selection decoding and data enabling. For this purpose, the decoder circuitry 50 decodes the four-bit card address provided on card address lines 135 and generates a responsive output on line 51 when such matrix driver board is selected by the card address signal for output. The output on line 51 is supplied to an enable input of an output buffering circuit 60.

Lines 62 consisting of the status output lines 97 and 98 from the sensing circuitry 90 are supplied to the output buffering circuit 60. The output buffering circuit 60 thereby receives the send line data and return line data from status outputs 97 and 98 respectively. When the output buffering circuit 60 receives an enabling input from the set decoder circuit 50, the output buffering circuit outputs the send line and return line data from the output status lines 97 and 98 onto the data lines 134.

Figure 4:
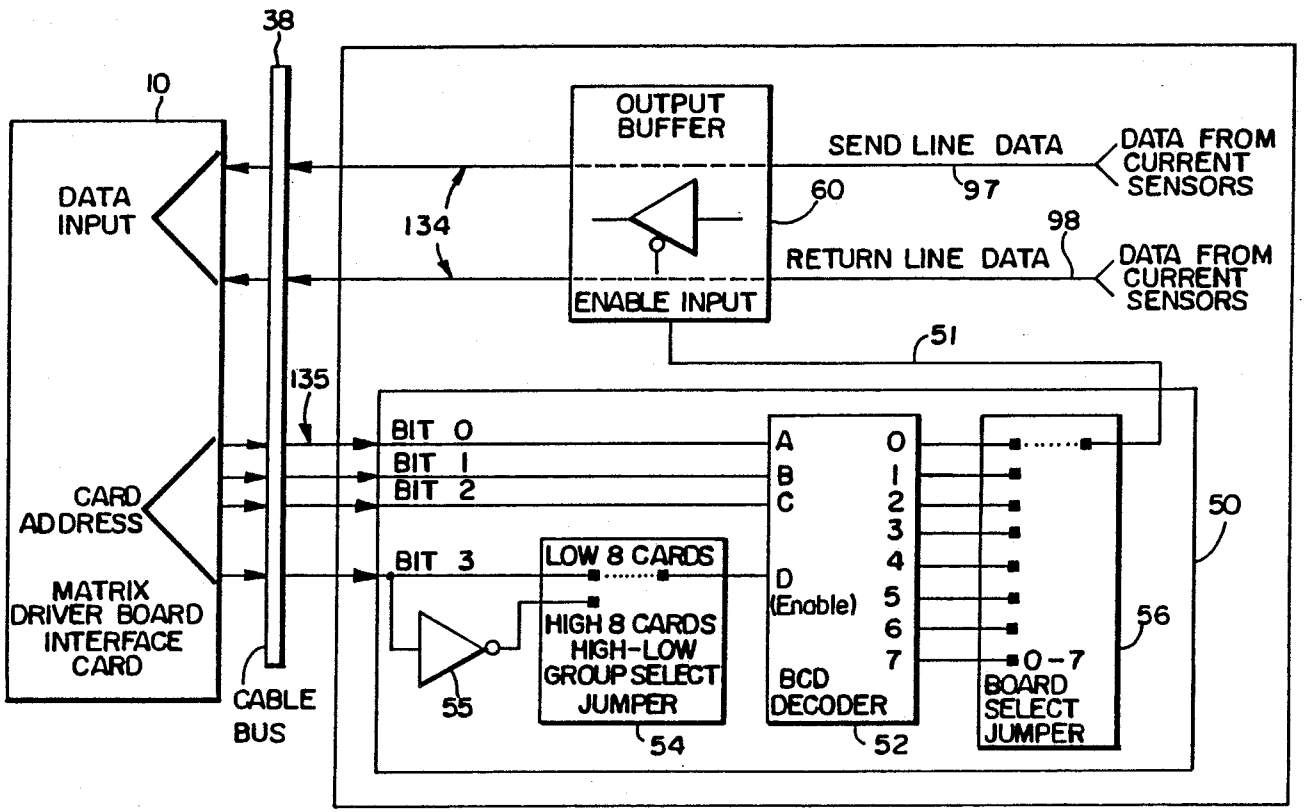
FIG. 4 is a schematic representation of an output buffer circuit and a board selection decoding and data enabling circuit employed on the matrix driver board.

The output buffering circuit 60 and the set decoder circuitry 50 are shown in greater detail in FIG. 4. As depicted, the card address lines 135 provide a four-bit address to the set decoder circuitry 50. Bits 0, 1, and 2 of the card address are supplied as inputs to input pins A, B and C of a BCD decoder 52.

The four-bit address provided by address lines 135 permits the selection of sixteen different sets of matrices for monitoring. To facilitate circuit design, the sixteen sets of matrices can be divided into two different groups of eight. Since each matrix driver board represents a different set of matrices, eight different matrix driver boards can be assigned a low group designation and eight other matrix driver boards can be assigned a high group designation. To distinguish between the groups, each matrix driver board includes a high-low group select jumper circuit 54 which receives bit 3 of the card address from card address lines 135 as an input. The high-low group select jumper circuit 54 functions to decode bit three to ascertain whether the low group of sixteen boards, designated as card 0 through card 7, is selected by the signal for potential output or whether the high group of boards, designated as card 8 through card F, is selected by the card address signal for potential output.

As shown in FIG. 4, the low group of boards, card 0 through card 7, each include a high-low group select jumper circuit 54 which is hardwired to pass the bit 3 signal from the card address lines 135 directly to a low enable input D of the BCD decoder 52. For the high group of boards, the high-low group select jumper circuit 54 would alternatively be hardwired so that the bit 3 address line would route through an inverter 55 before being connected to the low enable input pin D of the BCD decoder 52. In order to provide a low enabling signal to BCD decoder 52 when the high group of cards is selected, the inverter 55 functions to invert the digital high bit 3 signal used to select the high group of cards to a digital low signal for supply to the low enable input pin D of the BCD decoder 52.

When the BCD decoder 52 on a particular matrix driver board is enabled by the signal from the high-low group select jumper circuit 54, the BCD decoder 52 decodes the input received from bits 0–2 of the card address lines 135. The decoder 52 generates a responsive output on the output pin 0–7 of the BCD decoder 52 selected by bits 0–2 of the card address lines 135. The output pins 0–7 from the BCD decoder 52 are connected to a board select jumper circuit 56 which has its eight inputs respectively connected to the respective output pins 0–7 of the BCD decoder 52. One of the inputs of the board select jumper circuit 56 is hardwired to the output of the board select jumper circuit 56. The output of circuit 56 is, in turn, connected by output line 51 to the low enable input of the output buffering circuit 60.

Each matrix driver board in the low group and each matrix driver board in the high group has a different input on its board select jumper circuit 56 hardwired to the output of the circuit. This permits each matrix driver board to be separately addressed by card address lines 135 for output. The board select jumper circuit 56 of a particular matrix driver board enables an output from such matrix driver board only when the board select jumper circuit 56 of such matrix board is hardwired to the particular output pin of the BCD decoder 52 which is selected to be driven low by the BCD decoder 52 in response to the input to the BCD decoder 52 received from bits 0–2 of the card address lines 135. As shown in FIG. 4, for example, the board select jumper circuit 56 is jumpered so that output pin 0 of the BCD decoder 52 is supplied to line 51. If any output pin other than output pin 0 of the BCD decoder 51 is driven low, a digitally low enable signal will not be supplied to the output buffer circuit 60.

A specific operation of the monitoring system will now be considered when used in an application in which the switch circuits connected across the selected crosspoints of a selected matrx of send and return conductors includes normally closed sensing switches S as shown in FIG. 10. Under normal operation, when a selected return line of a matrix is supplied with a sourcing voltage potential and a selected send line of such matrix is supplied with a sinking voltage potential, the current detectors corresponding to the selected send and return lines will each indicate current flow by providing a low output on the respective status output lines 97 and 98. If the voltage bias is then reversed so that the send line is supplied with a sourcing voltage potential and the return line is supplied with a sinking voltage potential, the diode D in the switch circuit connecting the respective send and return conductors will block all current flow from the send conductor to the return conductor. As a result, the current sensors on both the send line and the return line will indicate no current flow by providing a high output on output status lines 97 and 98.

A truth table can be established showing the normal operation for a switch circuit having a normally closed sensing switch S under both forward and reverse biasing of the respective send and return conductors. Truth table A shows such normal operation where 1 indicates no current flow detected by the designated send or return line sensor; 0 indicates current flow detected by the designated send or return line sensor; R represents the selected return conductor for a particular sensing switch and V(R) represents the voltage applied to conductor R; and S represents the selected send conductor for such sensing switch and V(S) represents the voltage applied to conductor S; V(R)>V(S) represents the application of sourcing voltage potential to conductor R and sinking voltage potential to conductors S; and V(S)>V(R) represents the application of sourcing voltage potential to conductor S and sinking voltage potential to conductor R.

TABLE A

| NORMAL OPERATION | Send Line Sensor | Return Line Sensor |
|---|---|---|
| Forward Bias V(R)>V(S) | 0 | 0 |
| Reverse Bias V(S)>V(R) | 1 | 1 |

Since truth table A indicates the expected results under normal operation, variations from the expected conditions will reflect fault conditions including installation errors and tampering faults. Consequently, a series of truth tables can be used to show the system under different fault conditions.

Table B shows the truth table for a switch circuit in which the diode of the switch circuit has been improperly reversed, for example, during installation.

TABLE B

| REVERSED DIODE | Send Line Sensor | Return Line Sensor |
|---|---|---|
| Forward Bias V(R)>V(S) | 1 | 1 |
| Reverse Bias V(S)>V(R) | 0 | 0 |

Table C is the truth table for a switch circuit in which the selected send and return conductors to the switch circuit have been shorted across the switch circuit, for example, during tampering.

TABLE C

| SHORTED DIODE | Send Line Sensor | Return Line Sensor |
|---|---|---|
| Forward Bias V(R)>V(S) | 0 | 0 |
| Reverse Bias V(S)>V(R) | 0 | 0 |

Table D is a truth table for a switch circuit in which the send line to the selected switch circuit has been grounded and Table E is the truth table for a switch circuit in which the return line to the selected switch circuit has been grounded.

TABLE D

| GROUNDED SEND LINE | Send Line Sensor | Return Line Sensor |
|---|---|---|
| Forward Bias V(R)>V(S) | 1 | 0 |
| Reverse Bias V(S)>V(R) | 0 | 1 |

TABLE E

| GROUNDED RETURN LINE | Send Line Sensor | Return Line Sensor |
|---|---|---|
| Forward Bias V(R)>V(S) | 1 | 0 |
| Reverse Bias V(S)>V(R) | 1 | 1 |

In addition to applying forward and reverse biasing potentials between a selected send line and a selected return line, the system also has the capability to enable biasing of two selected send lines or two selected return lines for monitoring fault conditions. This type of testing enables the system to ascertain when two send lines become improperly shorted to one another or, alternatively, when two return lines become improperly shorted to one another. In addition, the system can detect an installation fault in which a switch circuit S incorporating diode D is inadvertantly connected between two send lines or two return lines. Table F is the truth table for the circuit in which a selected send line represented by $S_1$ is biased relative to another send line represented by $S_2$ under normal conditions. Table G is the related truth table for the same circuit in which send line $S_1$ is biased relative to send line $S_2$ under an abnormal condition in which the respective send lines are shorted together. The voltage applied to send line $S_1$ is represented by $V(S_1)$ and the voltage applied to send line $S_2$ is represented by $V(S_2)$ in Tables F and G.

TABLE F

| NORMAL SEND LINES | $S_1$ Send Line Sensor | $S_2$ Send Line Sensor |
|---|---|---|
| Forward Bias $V(S_1)>V(S_2)$ | 1 | 1 |
| Reverse Bias $V(S_2)>V(S_1)$ | 1 | 1 |

TABLE G

| SHORTED SEND LINES | $S_1$ Send Line Sensor | $S_2$ Send Line Sensor |
|---|---|---|
| Forward Bias $V(S_1)>V(S_2)$ | 0 | 0 |
| Reverse Bias $V(S_2)>V(S_1)$ | 0 | 0 |

Tables H and I show the truth tables for the circuit in which two selected return lines represented by $R_1$ and $R_2$ are biased relative to one another for testing. Table H is the trugh table for the circuit in which voltage $V(R_1)$ is applied to return line $R_1$ and voltage $V(R_2)$ is applied to return line $R_2$ for testing under normal conditions. Table I is the truth table for the related circuit in which the return lines $R_1$ and $R_2$ have been improperly shorted together.

TABLE H

| NORMAL RETURN LINES | $R_1$ Return Line Sensor | $R_2$ Return Line Sensor |
|---|---|---|
| Forward Bias $V(R_1)>V(R_2)$ | 1 | 1 |
| Reverse Bias $V(R_2)>V(R_1)$ | 1 | 1 |

TABLE I

| SHORTED RETURN LINES | $R_1$ Return Line Sensor | $R_2$ Return Line Sensor |
|---|---|---|
| Forward Bias $V(R_1)>V(R_2)$ | 0 | 0 |
| Reverse Bias $V(R_2)>V(R_1)$ | 0 | 0 |

As indicated from the above description and truth tables, a monitoring system is provided that enables the status of any switch circuit or pairs of conductors to be monitored for normal and abnormal conditions. The use of resistors R in the switch circuits coupled with the use of current magnitude sensing circuitry enhances the capability of the monitoring system by providing additional information on the type of fault conditions detected by the circuitry. For example, the shorting of a send conductor to a return conductor across a selected switch circuit causes resistor R of the switch circuit to become short circuited. In response to the short circuiting of resistor R, the current magnitude sensing circuitry for the respective send line and for the respective return line will detect increased current flow. The detection of increased current serves to confirm the existence of the short detected by the current sensing circuitry.

Even when selected pairs of conductors are systematically scanned by computer 12, monitoring of relatively large numbers of switch circuits can be accomplished in relatively short time periods. Various systematic approaches for analyzing conductor pairs of multiple sets of matrices can be employed. For example, one approach would be to program the computer 12 to sink a particular send line and source a particular return line. Each successive matrix driver board corresponding to the multiple sets of matrices could then be read to monitor the same conductor pairs in each set of matrices. After each matrix driver board has been read, the computer 12 can then source the next return line followed again by the reading of each successive matrix board. After each return line has been sourced and each successive matrix driver board has been read for a given send line, the program could then sink the next successive send line and reiterate the steps of sourcing each successive return line and reading each successive matrix driver board after each successive return line is sourced.

Once this process has been completed, the program could then transpose the biasing. For example, the circuitry would then source a send line and sink each successive return line followed by the reading of each successive matrix driver board after each successive return line is sunk. The program would then source the next successive send line and repeat the sequence of sourcing each successive return line followed by the reading of each successive matrix driver board after each return line is sunk. At selective intervals of scanning, the program could also step through successive sourcing and sinking of respective pairs of send lines followed by the sourcing and sinking of respective pairs of return lines for further testing.

Figure 11:
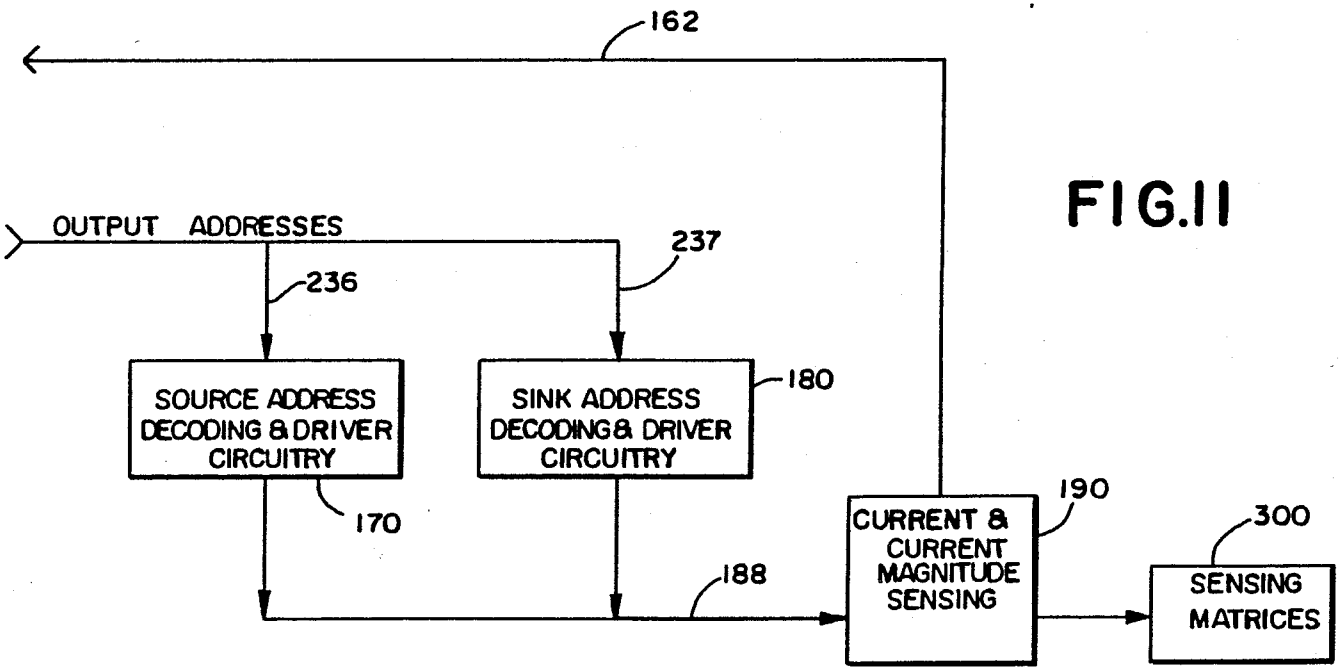
FIG. 11 is a block diagram of an expanded system in accordance with the present invention for simultaneously monitoring selected subsets of conductors in a sensing matrix or a set of matrices.

As shown in FIG. 11, a more generalized monitoring system is provided for simultaneously monitoring selected sets of send and return conductors of one or more matrices 300. As shown in FIG. 11, the system includes line selection circuitry in the form of source address decoding and driver circuitry 170 and sink address decoding and driver circuitry 180. The line selection circuitry is responsive to an input signal from computer 12 provided on address lines 236 and 237 to selectively permit the supply of sourcing voltage potential to a selected set of none, one or any of the send and return conductors and the supply of sinking voltage potential to a selected set of none, one, or any of the remaining send and return conductors.

The source address decoding and driver circuitry 170 is responsive to the address received on address lines 236. The source address decoding and driver circuitry 170 decodes the address received on address lines 236 to selectively permit the supply of sourcing voltage potential to the selected set of none, one or any of the send and return conductors.

The sink address decoding and driver circuitry 180 is responsive to the address received on address lines 237. The sink address decoding and driver circuitry 180 decodes the address received from address lines 237 to selectively permit the supply of sinking voltage potential to a selected set of none, one or any of the remaining send and return conductors.

The outputs of the source address decoding and driver circuitry 170 and the sink address decoding and driver circuitry 180 are connected with a line signal bus 188 which supplies the outputs from the source address decoding and driver circuitry 170 and the sink address decoding and driver circuitry 180 to the sensing matrix or set sensing matrices 300. As such, the bus 188 enables the output from the source address decoding and driver circuitry 170 to select the set of send and return conductors to be supplied with the sourcing voltage potential. Likewise, the bus 188 permits the output from the sink address decoding and driver circuitry 180 to select the particular set of send and return conductors to be supplied with the sinking voltage potential.

Monitoring circuitry 190 is connected with the bus 188 between the sensing matrix and the source address decoding and driver circuitry 170 and the sink address decoding and driver circuitry 180. The monitoring circuitry functions to sense current flow through selected subsets of the set of send and return conductors supplied with the sourcing voltage potential and the current flow through selected subsets of the set of send and return conductors supplied with the sinking voltage potential in order to monitor the status of selected conductors. For this purpose, the monitoring circuitry 190 includes current sensing circuitry for sensing current flow as well as current magnitude sensing circuitry for sensing the magnitude of current flow through the selected subsets of conductors. The pertinent data from the monitoring circuitry is output onto data lines 162 so that such data can be supplied to the computer 12.

The monitoring of sets of send and return conductors simultaneously increases the versatility and speed of the monitoring system. For example, the system is capable of selecting a single send line for supply with sourcing voltage potential and all the remaining send lines for supply with sinking voltage potential to simultaneously monitor whether the line supplied with the sourcing voltage potential is improperly shorted to any of the remaining lines supplied with the sinking voltage potential.

As another example, the system can select one return line for supply with sinking voltage potential and simultaneously select all of the send lines for supply with the sourcing voltage potential. This would enable the system to simultaneously monitor any abnormalities occurring in the connections between the return line and all of the send lines of a matrix. By eliminating the need for the system to sequentially step through selected pairs of conductors, efficiency is increased.

From the foregoing description, it can be seen that the present invention provides a flexible system for monitoring selected switch circuits and selected conductors under conditions of forward and reverse biasing. It should be recognized by those skilled in the art that changes or modifications may be made to the above-described embodiments without departing from the broad inventive concept of the invention. For example, the system can be readily adapted to monitor switch circuits having normally open switches such as commonly used in alarm systems. It should be understood, therefore, that the present invention is not limited to the particular embodiments disclosed herein, but is intended to cover all modifications which are within the scope and spirit of the appended claims.

What is claimed is:

1. A system for monitoring a plurality of switch locations comprising:

(a) means for supplying sourcing voltage potent (b) means for supplying sinking voltage potential;

(c) at least one matrix having a predetermined number of send conductors by a predetermined number of return conductors, the matrix having crosspoints between the send and return conductors to permit interconnection of selected send conductors with selected return conductors;

(d) switch circuits connected at selected crosspoints of the matrix of conductors, each of said switch circuits having a switch connecting a respective send conductor with a respective return conductor, each of said switch circuits permitting current flow through the switch circuit only in the direction from the respective return conductor to the respective send conductor;

(e) line selection circuitry responsive to an input signal to selectively permit the supply of the sourcing voltage potential to a selected set of any of the send and return conductors and to selectively permit the supply of the sinking voltage potential to a selected set of any of the send and return conductors; and (f) monitoring circuitry for sensing current flow through a selected subset of the set of send and return conductors supplied with the sourcing voltage potential and the current flow through a selected subset of the set of send and return conductors supplied with the sinking voltage potential to monitor the status of the selected subsets of conductors.

2. The system in accordance with claim 1 wherein the line selection circuitry is configured to be responsive to the input signal to selectively permit the supply of the sourcing voltage potential to at least a selected one of any of the send and return conductors and to selectively permit the supply of the sinking voltage potential to at least a selected one of any remaining send and return conductors.

3. The system in accordance with claim 2 wherein the monitoring circuitry senses current flow through a selected one of the send and return conductors supplied with the sourcing voltage potential and a selected one of the remaining send and return conductors supplied with the sinking voltage potential.

4. The system in accordance with claim 1, 2 or 3 wherein each of the switch circuits includes a resistor connected between the respective send and return conductors and said monitoring circuitry includes magnitude sensing circuitry for sensing the magnitude of current flow through the selected subset of the set of send and return conductors supplied with the sourcing voltage potential and the magnitude of current flow through the selected subset of the set of send and return conductors supplied with the sinking voltage potential to monitor the status of the selected subsets of conductors.

5. The system in accordance with claim 4 wherein each of the switch circuits includes a diode and wherein the diode, the resistor, and the switch of each of the switch circuits are connected in series between the respective send and return conductors.

6. The system in accordance with claim 5 wherein the switch is a normally closed switch.

7. The system in accordance with claim 1 or 2 wherein the input signal to the line selection circuitry includes an encoded input signal, and said line selection circuitry includes line decoder circuitry for decoding the encoded input signal to select the set of the send and return conductors for supply with one of the sinking and sourcing voltage potentials.

8. The system in accordance with claim 7 wherein the encoded input signal includes an encoded line sourcing signal and wherein said line decoder circuitry includes line sourcing decoder circuitry for decoding the encoded line sourcing signal to select the set of the send and return conductors to be supplied with the sourcing voltage potential.

9. The system in accordance with claim 8 wherein the line sourcing decoder circuitry includes a primary decoder for receiving an encoded input and generating a responsive output and a plurality of secondary decoders each for receiving an input and generating a responsive output and wherein a segment of the encoded line sourcing signal is supplied to the primary decoder and another segment of the encoded line sourcing signal is supplied to each of the secondary decoders and wherein the output from the primary decoder is supplied to each of the secondary decoders to selectively enable a selected one of the secondary decoders to generate an output identifying a selected one of the send and return conductors to be supplied with the sourcing voltage potential.

10. The system in accordance with claim 7 wherein the encoded input signal includes an encoded line sinking signal, and said line decoder circuitry includes line sinking decoder circuitry for decoding the encoded line sinking signal to select the set of the send and return conductors to be supplied with the sinking voltage potential.

11. The system in accordance with claim 10 wherein the line sinking decoder circuitry includes a primary decoder for receiving an encoded input and generating a responsive output and a plurality of secondary decoders each for receiving an input and generating a responsive output and wherein a segment of the encoded line sinking signal is supplied to the primary decoder of the line sinking decoder circuitry and another segment of the encoded line sinking signal is supplied to each of the secondary decoders of the line sinking decoder circuitry and wherein the output from the primary decoder of the line sinking decoder circuitry is supplied to each of the secondary decoders of the line sinking decoder circuitry to selectively enable a selected one of the secondary decoders of the line sinking decoder circuitry to generate an output identifying a selected one of the send and return conductors to be supplied with the sinking voltage potential.

12. The system in accordance with claim 1, 2, or 3 wherein the monitoring circuitry includes current sensing circuitry for sensing current flow through the selected subsets of send and return conductors.

13. The system in accordance with claim 12 wherein the current sensing circuitry includes a current sensor circuit for each one of the return and send conductors, each current sensor circuit being connected with a respective one of the return and send conductors for sensing current flow through the respective one of the return and send conductors to which such current sensor circuit is connected.

14. The system in accordance with claim 13 wherein each of said current sensor circuits includes an output isolation device connected with the respective one of the send and return conductors to which such current sensor circuit is connected, the output isolation device sensing current flow through the respective one of said send and return conductors to which such output isolation device is connected and having an electrically isolated output for providing an isolated output signal in response to current flow sensed by the output isolation device.

15. The system in accordance with claim 14 wherein each of said output isolation devices includes an optoelectric device having LED circuitry connected in series with the respective one of the send and return conductors to which such output isolation device is connected for emitting light when current flows through the LED circuitry, and a phototransistor providing the isolated output, such phototransistor being responsive to the light emitted from the LED circuitry for generating the isolated output signal to indicate current flow through the respective one of the send and return conductors to which such LED circuitry is connected.

16. The system in accordance with claim 15 comprising current magnitude sensing circuitry connected with the electrically isolated outputs of the output isolation devices to indicate the magnitude of current flow through the selected subsets of the sets of send and return conductors supplied the sourcing and sinking voltage potentials.

17. The system in accordance with claim 13 comprising current magnitude sensing circuitry connected with the current sensor circuits for indicating the magnitude of current flow through the selected subsets of the sets of send and return conductors supplied with the sourcing and sinking voltage potentials.

18. The system in accordance with claim 1, 2, or 3 wherein said monitoring circuitry includes current magnitude sensing circuitry for sensing the magnitude of current flow through the selected subset of the set of send and return conductors supplied with the sourcing voltage potential and the selected subset of the set of send and return conductors supplied with the sinking voltage potential.

19. The system in accordance with claim 1 including transient suppression circuitry connected with each of the send and return conductors to suppress transient voltages on such conductors.

20. The system in accordance with claim 1 comprising a plurality of the matricies of conductors, each matrix having a respective predetermined number of send conductors by a predetermined number of return conductors and wherein said switch circuits are connected at selected crosspoints of each matrix of conductors and the send and return conductors of each of the respective matrices are connected with said line selection circuitry and said monitoring circuitry.

21. A system for monitoring a plurality of switch locations comprising:

(a) means for supplying sourcing voltage potential;

(b) means for supplying sinking voltage potential;

(c) a plurality of sets of matrices of conductors, each set having at least one matrix having a respective predetermined number of send conductors by a predetermined number of return conductors, each matrix having crosspoints between the send and return conductors of the respective matrix to permit interconnection of selected send conductors with selected return conductors of the respective matrix;

(d) switch circuits connected at selected crosspoints of each matrix of conductors, each of said switch circuits having a switch connecting a respective send conductor with a respective return conductor of the respective matrix, each of said switch circuits permitting current flow through the switch circuit only in the direction from the respective return conductor to the respective send conductor of the respective matrix;

(e) line selection circuitry for each set of matrices responsive to an input signal to selectively permit the supply of the sourcing voltage potential to a selected set of any of the send and return conductors of the respective set of matrices and to selectively permit the supply of the sinking voltage potential to a selected set of any of the remaining send and return conductors of the respective set of matrices; and (f) monitoring circuitry for each set of matrices for sensing current flow through a selected subset of the set of send and return conductors of the respective set of matrices supplied with the sourcing voltage potential and the current flow through a selected subset of the set of remaining send and return conductors of the respective set of matrices supplied with the sinking voltage potential to monitor the status of the selected subsets of conductors;

(g) a status output for each set of matrices for providing the status of the selected subset of the set of send and return conductors of the respective set of matrices supplied with the sourcing voltage potential and the status of the selected subset of the set of remaining send and return conductors of the respective set of matrices supplied with the sinking voltage potential; and (h) set selection circuitry responsive to an input signal to selectively enable a selected set of matrices to output the status of the selected subset of the set of send and return conductors supplied with the sourcing voltage potential in such respective set of matrices and to output the status of the selected subset of the set of send and return conductors supplied with the sinking voltage potential in such respective set of matrices.

22. The system in accordance with claim 21 wherein the input signal to the set selection circuitry comprises an encoded set selection signal and said system comprises set decoder circuitry for each set of matrices for decoding the encoded set selection signal to enable the set of matrices selected by the encoded set selection signal to output the status of the selected subsets of conductors of such respective set of matrices.

23. The system in accordance with claim 22 wherein said set decoder circuitry generates an enable signal for the respective set of matrices selected for output by the encoded set selection signal and wherein said system comprises an output circuit responsive to the enable signal from the set decoder circuitry to enable monitoring of current flow through the selected subsets of conductors in such set of matrices.

24. A system for monitoring a plurality of switch locations comprising:

(a) means for supplying sourcing voltage potential;

(b) means for supplying sinking voltage potential;

(c) at least one matrix having a predetermined number of send conductors by a predetermined number of return conductors, the matrix having crosspoints between the send and return conductors to permit interconnection of selected send conductors with selected return conductors;

(d) switch circuits connected at selected crosspoints of the matrix of conductors, each of said switch circuits having a switch connecting a respective send conductor with a respective return conductor, each of said switch circuits permitting current flow through the switch circuit only in the direction from the respective return conductor to the respective send conductor;

(e) line selection circuitry responsive to an input signal to selectively permit the supply of the sourcing voltage potential to at least a selected one of any of the send conductors and to selectively permit the supply of the sinking voltage potential to at least a selected one of any of the return conductors and wherein said line selection circuitry is responsive to the input signal to selectively permit the supply of the sourcing volrtage potential to at least a selected one of any of the return conductors and to selectively permit the supply of the sinking voltage potential to at least a selected one of any of the second conductors; and (f) monitoring circuitry for sensing current flow through at least the selected one of the send conductors suppled with the sourcing voltage potential and the current flow through at least the selected one of the return conductors supplied with the sinking voltage potential to monitor the status of the selected conductors supplied with the sourcing and sinking potentials and wherein said monitoring circuitry senses current flow through at least the selected one of the return conductors suppled with the sourcing voltage potential and the current flow through at least the selected on of the send conductors suppled with the sinking voltage potential to monitor the status of the selected conductors supplied with the sourcing and sinking potentials.

25. A system for monitoring a plurality of switch locations comprising:

(a) means for supplying sourcing voltage potential;

(b) means for supplying sinking votlage potential;

(c) at least one matrix having a predetermined number of send conductors by a predetermined number of return conductors, the matrix having crosspoints between the send and return conductors to permit interconnection of selected send conductors with selected return conductors;

(d) switch circuits connected at selected crosspoints of the matrix of conductors, each of said switch circuits having a switch connecting a respective send conductor with a respective return conductor, each of said switch circuits permitting current flow through the switch circuit only in the direction from the respective return conductor to the respective send conductor;

(e) line selection circuitry responsive to an input signal to selectively permit the supply of the sourcing voltage potential to at least a selected one of any of the send conductors and the supply of the sinking voltage potential to at least a selected one of any of the remaining send conductors; and (f) monitoring circuitry for sensing current flow through at least the selected one of the send conductors suppled with the sourcing voltage potential and the current flow through at least the selected one of the remaining send conductors supplied with the sinking voltage potential to monitor the status of the selected conductors suppled with the sourcing and sinking voltage potentials.

26. A system for monitoring a plurality of switch locations comprising:

(a) means for supplying sourcing voltage potential;

(b) means for supplying sinking voltage potential;

(c) at least one matrix having a predetermined number of send conductors by a predetermined number of return conductors, the matrix having crosspoints between the send and return conductors to permit interconnection of selected send conductros with selected return conductors;

(d) switch circuits connected at selected crosspoints of the matrix of conductors, each of said switch circuits having a switch connecting a respective send conductor with a respective return conductor, each of said switch circuits permitting current flow through the switch circuit only in the direction from the respective return conductor to the respective send conductor;

(e) line selection circuitry responsive to an input signal to selectively permit the supply of the sourcing voltage potential to at least a selected one of any of the return conductors and the supply of the sinking voltage potential to at least a selected one of any of the remaining return conductors; and (f) monitoring circuitry for sensing current flow through at least the selected one of the return conductors supplied with the sourcing voltage potential and the current flow through at least the selected one of the remaining return conductors supplied with the sinking voltage potential to monitor the status of the selected conductors suppled with the sourcing and sinking voltage potentials.

* * * * *

UNITED STATES PATENT AND TRADEMARK OFFICE

CERTIFICATE OF CORRECTION

PATENT NO. : 4,970,508

DATED : November 13, 1990

INVENTOR(S) : Daniel T. Webster, III

It is certified that error appears in the above-identified patent and that said Letters Patent is hereby corrected as shown below:

Column 7, line 10, after "switch" delete "oircuit" and insert --circuit--;

Column 7, line 43, after "circuit" delete "n" and insert --in--;

Column 17, line 21, after "H is the" delete "trugh" and insert --truth--;

Claim 1 at column 19, line 58, after "sourcing voltage" delete "potent" and insert --potential;--;

Claim 24 at column 24, line 3, after "the sourcing" delete "volrtage" and insert --voltage--;

Claim 24 at column 24, line 7, before "conductors" delete "second" and insert --send--;

Claim 24 at column 24, line 10, after "ductors" delete "suppled" and insert --supplied--;

Claim 24 at column 24, line 17, after "conductors" delete "suppled" and insert --supplied--;

Claim 24 at column 24, line 19, after "selected" delete "on" and insert --one--;

Claim 24 at column 24, line 20, after "conductors" delete "suppled" and insert --supplied--;

Claim 25 at column 24, line 26, after "sinking" delete "votlage" and insert --voltage--;

PRINTER'S TRIM LINE

UNITED STATES PATENT AND TRADEMARK OFFICE
CERTIFICATE OF CORRECTION

PATENT NO. : 4,970,508

DATED : November 13, 1990

INVENTOR(S) : Daniel T. Webster, III

It is certified that error appears in the above-identified patent and that said Letters Patent is hereby corrected as shown below:

Claim 25 at column 24, line 49, after "ductors" delete "suppled" and insert --supplied--;

Claim 25 at column 24, line 53, after "conductors" delete "suppled" and insert --supplied--;

Claim 25 at column 24, line 63, after "selected send" delete "conductros" and insert --conductors--; and Claim 26 at column 26, line 9, after "conductors" delete "suppled" and insert --supplied--.

Signed and Sealed this

Ninth Day of February, 1993

*Attest:*

STEPHEN G. KUNIN

*Attesting Officer*

*Acting Commissioner of Patents and Trademarks*